United States Patent [19]

Hamada

[11] 3,972,458

[45] Aug. 3, 1976

[54] PAPER HOLDER

[76] Inventor: Shotaro Hamada, 12-35, Chuo 1-chome, Kofu, Yamanashi, Japan

[22] Filed: Sept. 15, 1975

[21] Appl. No.: 613,507

[30] Foreign Application Priority Data

Sept. 18, 1974 Japan ..... 49-111730[U]

[52] U.S. Cl. ..... 225/20; 225/43; 225/52; 225/79; 225/85; 225/90

[51] Int. Cl.[2] ..... B26F 3/02

[58] Field of Search ..... 225/42, 43, 46, 47, 225/51, 52–67, 77, 79, 80, 82, 84, 85, 88, 90, 91; 242/75.2; 206/225, 226, 397, 408, 409

[56] References Cited

UNITED STATES PATENTS

| | | | |
|---|---|---|---|
| 1,512,849 | 10/1924 | Isham | 225/88 X |
| 2,062,418 | 12/1936 | King | 225/88 X |
| 2,139,071 | 5/1943 | Mason | 225/52 X |
| 2,832,549 | 4/1958 | Youngberg | 225/85 X |
| 2,954,910 | 10/1960 | Monerieff | 225/20 |
| 3,731,863 | 5/1973 | Nausedas | 225/20 |

*Primary Examiner*—Othell M. Simpson
*Assistant Examiner*—Fred A. Silverberg
*Attorney, Agent, or Firm*—Robert E. Burns; Emmanuel J. Lobato; Bruce L. Adams

[57] ABSTRACT

A paper holder for supporting a paper roll and for tearing it to a given length as it is reeled off the roll. The holder comprises a casing which rotatably supports a paper roll, and a retaining cover which is pivotally mounted on the casing at its one end. Casing includes a bearing surface over which a length of the paper web extends as it is reeled off the roll, and the retaining cover includes an abutment adjacent to its other end which bears against the bearing surface with the paper length interposed therebetween. Adjacent to its other end, the cover is also formed with a slot for passing the paper length upwardly therethrough. The paper length which is let through the slot is turned back and then allowed to hang down. Under this condition, the paper is retained between the abutment and the bearing surface to prevent a further withdrawal of the paper if the free end of the paper web is pulled downward, thus allowing the withdrawn paper length to be torn off by a cutting edge which is located at the other end of the retaining cover or extending from the casing.

4 Claims, 6 Drawing Figures

PAPER HOLDER

The invention relates to a paper holder, and more particularly to a paper holder which supports and cuts a required length of paper from a roll thereof such as a roll of toilet paper.

A conventional paper holder having a removal axle for carrying a hollow bobbin of a paper roll includes a top cover which rides on the mounted paper roll by gravity, the edge of the top cover being effective to tear off a length of the paper which is reeled off the roll. Thus, one hand is used to withdraw a required length of paper from the roll, and the paper length is torn by moving it across the edge of the top cover while maintaining the top cover against the paper roll with the other hand. This results in an inconvenience that both hands must be used to tear off a length of the paper. Also, when the paper length is torn, the cut end of the paper is left under the top cover, which must be raised to withdraw the paper next time.

Therefore, it is an object of the invention to provide a paper holder which permits a length of paper to be withdrawn from a paper roll and torn off with only one hand.

It is another object of the invention to provide a paper holder in which the cut end of the paper from its roll is externally exposed to permit an easy access thereto.

It is a further object of the invention to provide a paper holder which is simple in structure and can be used in the manner as with a conventional paper holder.

In accordance with the invention, there is provided a paper holder comprising a casing which rotatably supports a paper roll, and a retaining cover which is pivotally mounted on the casing at its one end, the casing including a bearing surface over which a length of paper web extends as it is withdrawn from the roll, the retaining cover including an abutment adjacent to its other end which is adapted for engagement with the bearing surface with a length of paper interposed therebetween, the cover also including a slot adjacent to the other end thereof for passing a portion of the paper to be led upwardly of the retaining cover after it has passed between the abutment and the bearing surface, this portion of the paper being turned back to hand down, whereby the paper length is positively retained between the abutment and bearing surface and its further withdrawal is prevented when a tension is applied to the paper web. A length of the paper which is reeled off the roll can be torned off by moving it across a cutting edge which is formed at the other end of the retaining cover or that projecting from the casing at a position below the retaining cover, while carrying it with one hand.

The above and other objects, features and advantages of the invention will become apparent from the following detailed description of several embodiments thereof shown in the drawings, in which.

Figure 2:
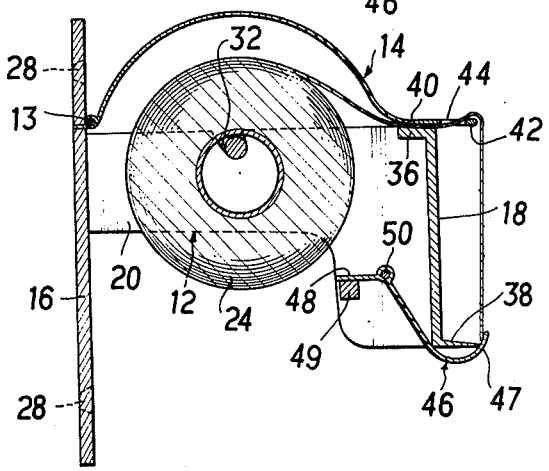
FIG. 2 is a cross section taken along the line II—II shown in FIG. 1.
Figure 3A:
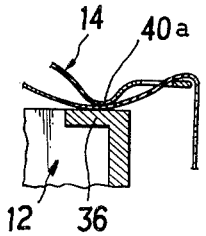
Figure 3B:
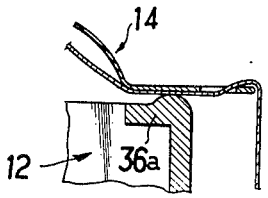
Figure 5:
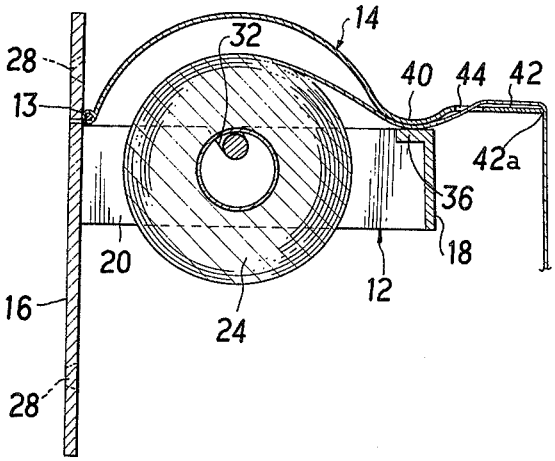
Figure 4:
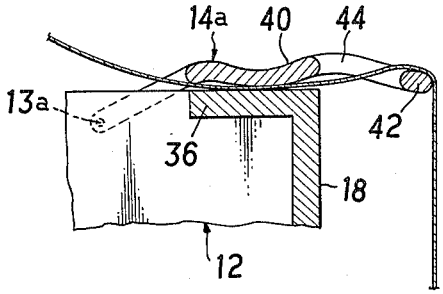

FIGS. 3*a* and 3*b* are similar sections illustrating modifications of the abutment and the bearing surface;

FIG. 4 is a cross section of a retaining cover which is slightly different from that shown in FIG. 2; and FIG. 5 is a cross section of another embodiment of the paper holder according to the invention.

Figure 1:
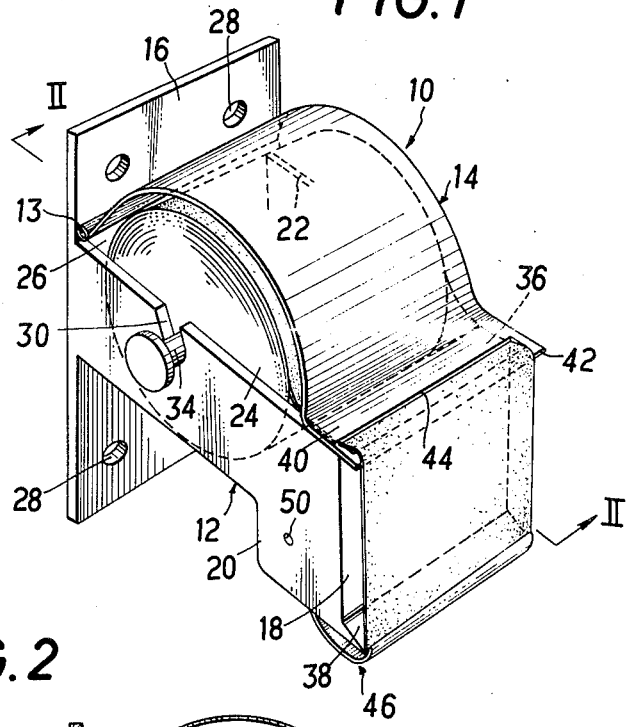
FIG. 1 is a perspective view of the paper holder according to the invention.

Referring to FIG. 1, there is shown a paper holder generally designated by numeral 10 which comprises a casing 12 and a retaining cover 14. The casing 12 is formed of a hard material such as suitable hard plastic, and includes a rear upright portion 16 and a front upright portion 18 which are integrally connected together by a pair of sidewalls 20, 22, defining a rectangular receiving space 26 in which a paper roll 24 is received. The rear upright portion 16 is formed with a plurality of apertures 28 which receive set screws for securing the casing 12 to a desired position on the wall of a building. The sidewalls 20, 22 of the casing 12 are formed with a pair of recesses 30, 32 which removably receives a mandrel 34 which in turn rotatably supports the paper roll 24. At its top, the front upright portion 18 of the casing 12 is integrally formed with a flange 36 (see FIG. 2) which defines a bearing surface over which a length of paper is placed as it is reeled off the roll 24. In the embodiment shown, the front upright portion 18 is formed at its lower end with a cutting edge 38 in the form of a flange extending forwardly or away from the rear portion 16 for tearing off the paper, as will be further described later.

The retaining cover 14 is formed of a hard material such as stainless steel and is generally curved in configuration so as to cover the paper roll 24 which is placed within the receiving space 26. At its one end, the cover is pivotally mounted on the rear upright portion 16 of the casing 12 by means of a hinge 13 so as to be rotatable thereabout. As indicated in FIG. 2, the other end of the retaining cover 14 is formed as an abutment 40 which is positioned above the bearing surface 36 of the casing 12. The gravity of the retaining cover 14 is effective to retain a portion of the paper held sandwiched between the abutment 40 and the bearing surface 36, but does not prevent a withdrawal of the paper through the clearance therebetween. At a position forwardly of the abutment 40, the retaining cover 14 is integrally formed with a frame portion 43 which defines a withdrawal slot 44 therein. The slot 44 permits a portion of the paper to pass therethrough after it has passed between the bearing surface 36 and the abutment 40, the paper portion being extended around the frame portion 42 so as to hang down freely to a position adjacent to the cutting edge 38.

In use, the paper roll 24 is rotatably received within the space 26, and the end of the paper is reeled off the roll and passed between the bearing surface 36 and the abutment 40 and through the slot 44 and then turned around the frame portion 42 so as to hang down to a position adjacent to the cutting edge 38. When a use is desired, the hanging paper portion is held by one hand to draw a further length from the roll, which is then torn off by moving it across the curring edge 38. During the cutting process, the paper is drawn in the downward direction to press against the frame portion 42, so that the abutment 40 is urged against the bearing surface 36 to retain and to prevent a further withdrawal of the paper, thus assuring a positive tearing operation at the cutting edge 38. The cut end of the paper freely hangs down from the frame portion 42, thus facilitating a next withdrawal.

In the arrangement described, the hand may come into contact with the cutting edge 38 when holding the hanging paper portion. This can be avoided by the provision of a protective cover 46. As shown in FIG. 2, the protective cover is rotatably journaled on a pivot 50 which extends between the sidewalls 20, 22 of the casing 12. A weight 49 is attached to its one end so as to bias the other end 47 normally to a position covering the cutting edge 38. However, when the hanging paper portion is held by hand and moved across the cutting edge 38, the end 47 of the cover 46 is rotated clockwise about the pivot 50 so as to be further removed from the cutting edge 38, thus allowing a tearing of the paper. It will be understood that the weight 49 may be replaced by a spring to provide a bias to the protective cover 46.

FIGS. 3*a* and 3*b* show a modified abutment 40*a* and a modified bearing surface 36*a*, which may be used to hold paper in place in a positive manner.

FIG. 4 shows a modified retaining cover 14*a* which does not cover the paper roll 24. At its one end, the cover 14*a* is pivotally mounted on a pin 13*a* which extends across the sidewalls 20, 22 of the casing 12. However, it is provided with an abutment 40 for bearing engagement with the bearing surface 36 of the casing 12 and also with a frame portion 42 defining a withdrawal slot 44 as mentioned previously.

FIG. 5 shows another embodiment of the paper holder according to the invention in which the front upright portion 18 of the casing 12 is not provided with a cutting edge, but instead the frame portion 42 of the retaining cover 14 is elongated beyond the withdrawal slot 44 so that its extremity 42*a* serves as a cutting edge. In this arrangement, the end of the paper lying on the frame portion 42 may be held to withdraw a required length thereof, as measured from the edge 42*a*, from the roll, and pulled downward, whereupon the abutment 40 retains the paper against the bearing surface 36 and the withdrawn paper length can be torn off by the edge 42*a*. A small length of the paper remains on the frame portion 42, which can be used when withdrawing the paper next time.

While the invention has been specifically described with reference to specific embodiments thereof, it should be understood that they are exemplary only, and not limitative, of the invention and that the scope of the invention is solely defined by the appended claims.

What is claimed is:

1. A paper holder comprising a casing for rotatably supporting a paper roll and having a bearing surface over which a length of paper extends as it is reeled off the roll, and a retaining cover pivotally mounted on the casing at its one end and including an abutment adjacent to its other end which is located for engagement with the bearing surface with a paper interposed therebetween, the cover also including a withdrawal slot for passing a paper length therethrough after it has passed between the abutment and the bearing surface, the paper length which is led through the slot being turned around the other end of the retaining cover so that when it is pulled downward, the paper length is retained in position between the abutment and bearing surface.

2. A paper holder according to claim 1 in which the other end of the retaining cover serves as a cutting edge.

3. A paper holder according to claim 1 in which the casing is formed with a cutting edge at a position below the bearing surface.

4. A paper holder according to claim 3, further including a protective cover pivotally mounted on the casing and normally biased to cover the cutting edge, the protective cover being movable away from the cutting edge as the paper length is moved across the cutting edge.

* * * * *